US006027169A

United States Patent [19]

Roslund, Jr.

[11] Patent Number: 6,027,169

[45] **Date of Patent: *Feb. 22, 2000**

[54] FORWARD-REARWARD TILT CONTROL FOR CHAIR

[75] Inventor: Richard N. Roslund, Jr., Georgetown Township, Mich.

[73] Assignee: Haworth, Inc., Holland, Mich.

[ * ] Notice: This patent issued on a continued prosecution application filed under 37 CFR 1.53(d), and is subject to the twenty year patent term provisions of 35 U.S.C. 154(a)(2).

[21] Appl. No.: 09/149,684

[22] Filed: Sep. 9, 1998

Related U.S. Application Data

[62] Division of application No. 08/647,378, May 9, 1996, Pat. No. 5,810,439.

[51] Int. Cl.[7] ..... A47C 1/02

[52] U.S. Cl. ..... 297/337; 297/440.22; 297/341; 24/136 R

[58] Field of Search ..... 297/337, 440.22, 297/391; 24/652, 115 M, 136 R

[56] References Cited

U.S. PATENT DOCUMENTS

| | | | |
|---|---|---|---|
| 2,579,305 | 12/1951 | Cushman . | |
| 2,627,898 | 2/1953 | Jackson . | |
| 2,646,839 | 7/1953 | Hillman . | |
| 2,703,137 | 3/1955 | Bierman | 297/440.22 |
| 3,059,890 | 10/1962 | Radke et al. . | |
| 3,235,308 | 2/1966 | Conner | 297/337 |
| 3,489,459 | 1/1970 | Katan, Sr. et al. . | |
| 4,593,951 | 6/1986 | Slaats et al. . | |
| 5,035,466 | 7/1991 | Mathews et al. . | |
| 5,035,467 | 7/1991 | Axelson | 297/440.22 |
| 5,282,670 | 2/1994 | Karsten et al. . | |
| 5,575,534 | 11/1996 | Yu | 297/337 |
| 5,755,488 | 5/1998 | Beda et al. . | |
| 5,782,536 | 7/1998 | Heidmann et al. | 297/337 |

FOREIGN PATENT DOCUMENTS

| | | |
|---|---|---|
| 226408 | 3/1963 | Germany . |

*Primary Examiner*—Peter M. Cuomo
*Assistant Examiner*—Anthony D. Barfield
*Attorney, Agent, or Firm*—Flynn, Thiel, Boutell & Tanis, P.C.

[57] ABSTRACT

An office-type chair is provided with a base, a seat-back arrangement including a seat assembly which is vertically tiltable relative to the base and a back assembly which is vertically tiltable relative to both the seat assembly and bases and a tilt control mechanism operatively coupled between the base and the seat-back arrangement for permitting the back assembly and seat assembly to be respectively rearwardly and downwardly tilted away from an upright position in a synchronous but differential rate. A front tilt control device is associated with and interconnected with the tilt control mechanism for permitting the seat and back assemblies to be synchronously and nondifferentially tilted forwardly away from the upright position.

20 Claims, 13 Drawing Sheets

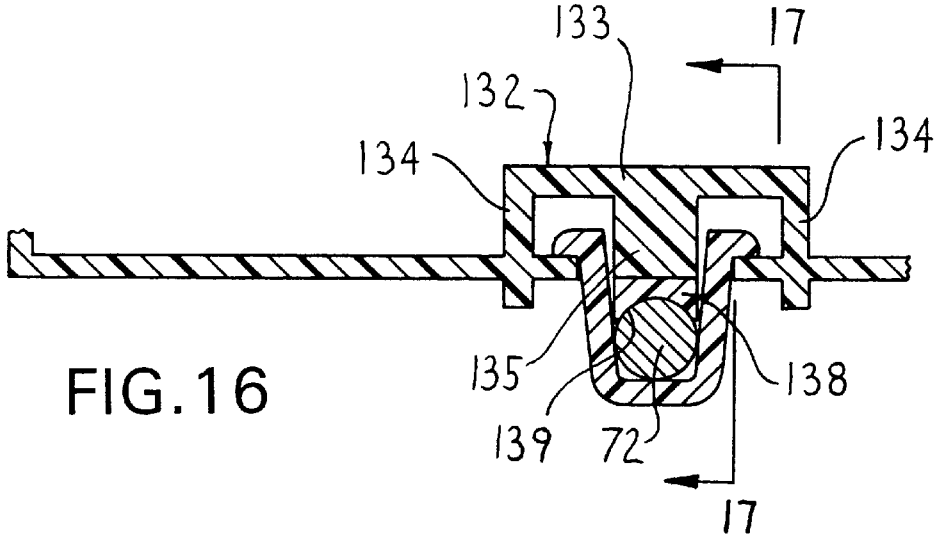
FIG.16
FIG.17
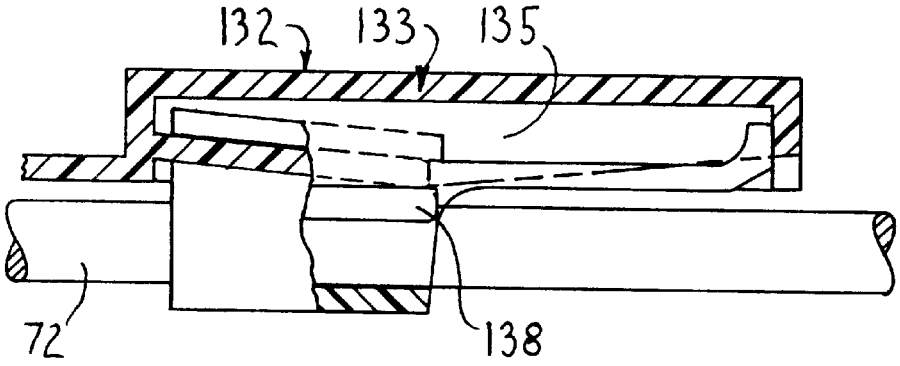
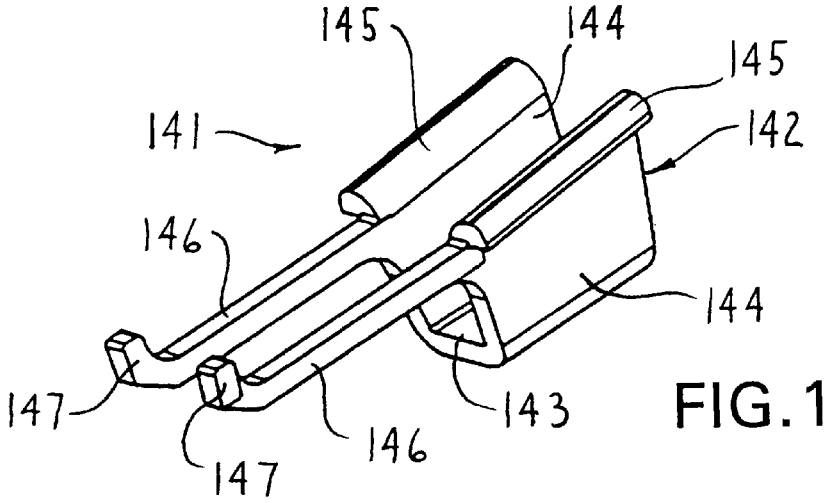
FIG.18

FORWARD-REARWARD TILT CONTROL FOR CHAIR

This is a division of Ser. No. 08/647,378, filed May 9, 1996 now U.S. Pat. No. 5,810,459.

FIELD OF THE INVENTION

This invention relates to an improved control mechanism for a chair which permits synchronous differential tilting of the seat and back during rear tilting of the chair, and more specifically includes occupant activated structure which permits the seat and back to effectively tilt together as a unit when the chair is tilted forwardly from its normal upright position.

This invention also relates to an improved seat arrangement for an office-type chair, which seat arrangement permits the seat member to be selectively slidably moved by the occupant in the front-to-back direction.

BACKGROUND OF THE INVENTION

Office chairs have been developed which permit the back to be tilted synchronously with the seat but at a greater rate so that the back tilts relative to the seat as the latter tilts relative to the chair base. Such chairs commonly incorporate what is often referred to as a synchrotilt control mechanism so as to permit the simultaneous but differential rearward tilting of the seat and back away from the normal upright position, with this differential tilting of the back and seat typically being in the ratio of about 2 to 1. Many of these mechanisms provide a pivot or tilt axis in the vicinity of the front edge of the seat to prevent undesired lifting of the seat front edge when the occupant tilts the chair rearwardly away from the normal upright position. In addition to these conventional rearward tilting movements, many chairs have also been developed which enable the seat to effectively pivot forwardly from the normal upright position, that is, the seat can be made to assume a position wherein it slopes downwardly in a forward direction so that the rear of the seat is at an elevation above the front of the seat. This forward tilt feature on the seat has been found to be highly desirable in many of the more intensive work environments such as when the chair occupant is working on a keyboard or doing intensive paperwork on a worksurface such as a desk or table. The incorporation of this forward seat tilt feature into chairs provided with a control mechanism which provides synchronous differential rearward tilting of the seat and back, however, has created additional complications which in many chairs have not been satisfactorily resolved.

For example, in known synchrotilt chairs wherein a forward seat tilt feature has been incorporated in addition to the synchronous differential rearward tilting of the seat and back, the synchronous differential tilting relationship between the seat and back continues to function irrespective of whether the seat and back are being tilted forwardly or rearwardly from the normal upright position. Hence, while this provides for satisfactory performance during rearward tilting from the normal upright position since the angle between the seat and back increases during such rearward tilting, nevertheless the functional performance of this mechanism during forward tilting is undesirable since the angle between the seat and back decreases as the seat and back are tilted forwardly from the normal upright position. This closure of the angle between the seat and back during forward tilt thus causes the chair to be uncomfortable and severely restricts the occupant's satisfactory use of the chair when in the forward tilt position.

To overcome the aforementioned problem and disadvantage, one known chair which incorporates a synchrotilt mechanism for permitting synchronous differential rearward tilting of the seat and back has been provided with a mechanism which permits only the seat to undergo forward tilt. With this arrangement, the angle between the seat and back thus increases when the seat is in the forward tilt position in comparison to the normal upright position. This positioning of the back, however, is undesirable when the occupant is carrying out intensive work on a table or desk, such as writing and the like, since under such work conditions an occupant often wishes to sit on the forwardly inclined seat in a forwardly leaning position, and in such case the back of the chair, being in the stationary upright position, is not disposed for supportive engagement with the occupant's back.

In another chair which has been developed to provide both rearward and forward tilt, only the back is permitted to tilt rearwardly under normal chair usage. While the seat and back can be tilted forwardly as a unit, this requires two separate actuators for controlling forward tilt and tilt locking. This known chair also does not provide advantageous synchronous differential rear tilting.

Still another disadvantage associated with many of the known chairs which have attempted to provide both rearward and forward tilt capabilities is the number of control arms or buttons which must be activated by the chair occupant in order to move the chair into a forward tilt position. In many such chairs it has been observed that the occupant must often activate two or more lever arms, buttons or control knobs before the chair can be forwardly tilted, and such complex control makes use of the chair confusing and difficult since in such cases it has been observed that the chair may possess as many as four different actuators positioned under the chair seat so as to control the various chair functions, and this large number of actuators is often confusing to the chair occupant, particularly in those situations where the chair is not one which is used on a high intensity basis by solely the same occupant.

Accordingly, it is an object of this invention to provide an improved chair which provides for synchronous differential rearward tilting of the seat and back away from the normal upright position, and which improved chair in addition permits forward tilting of the seat and back away from the upright position, which forward tilting occurs with the differential synchronous movement disabled so that the seat and back effectively tilt forwardly as a unit so as to maintain a substantially constant angle between the seat and back.

More specifically, according to one aspect of the invention, the improved chair, as aforesaid, incorporates a synchronous tilt control mechanism which connects the chair base to the seat and back to permit rearward synchronous differential tilting thereof away from the normal upright positions, with this synchronous tilt control mechanism also incorporating a control linkage which can be adjusted between forward and rearward tilt positions so that, when in the forward tilt position, the differential synchronous relationship is disabled, and the seat and back will thus tilt forwardly away from the upright position without causing any significant differential tilting between the seat and back.

A further aspect of the invention is an improved chair, as aforesaid, wherein the linkage which disables the differential synchronous tilting relationship is activated by a single occupant-engaged control arm or element disposed in the vicinity of the underside of the chair so as to provide for simple occupant control over forward tilt when such forward tilt is desired.

A still further aspect of the invention is an improved chair, as aforesaid, wherein the single control which disables the differential synchrotilt linkage to permit forward tilt also automatically activates a multi-position lock device so that as the seat and back assemblies are tilted forwardly as a unit, the lock device will automatically maintain the seat and back in the forwardly tilted position, depending upon the angle through which forward tilt occurs.

Still a further aspect of the invention in an improved chair, particularly a chair having both forward and rearward tilt capabilities as aforesaid, having an improved seat assembly whereby the seat assembly includes a seat support member which is movably supported on the chair control, and which seat support member in turn mounts thereon the seat, which seat can be slidably displaced along the seat support member in the front-to-back direction and selectively locked by the occupant in a desired position by the occupant so as to provide the occupant with improved seating comfort by permitting selection of seat position relative to the back. This seat assembly particularly employs constructional features which facilitate the economical manufacture and assembly thereof.

Other objects and purposes of the invention will be apparent to persons familiar with chairs of this general type upon reading the following specification and inspecting the accompanying drawings.

BRIEF DESCRIPTION OF THE DRAWINGS

FIG. 16 is a fragmentary sectional view taken generally along line 16—16 in FIG. 15.

FIG. 17 is a sectional view taken generally along line 17—17 in FIG. 16.

FIG. 18 is a perspective view of the retainer or clip which secures the seat shell to the seat support member.

Figure 1:
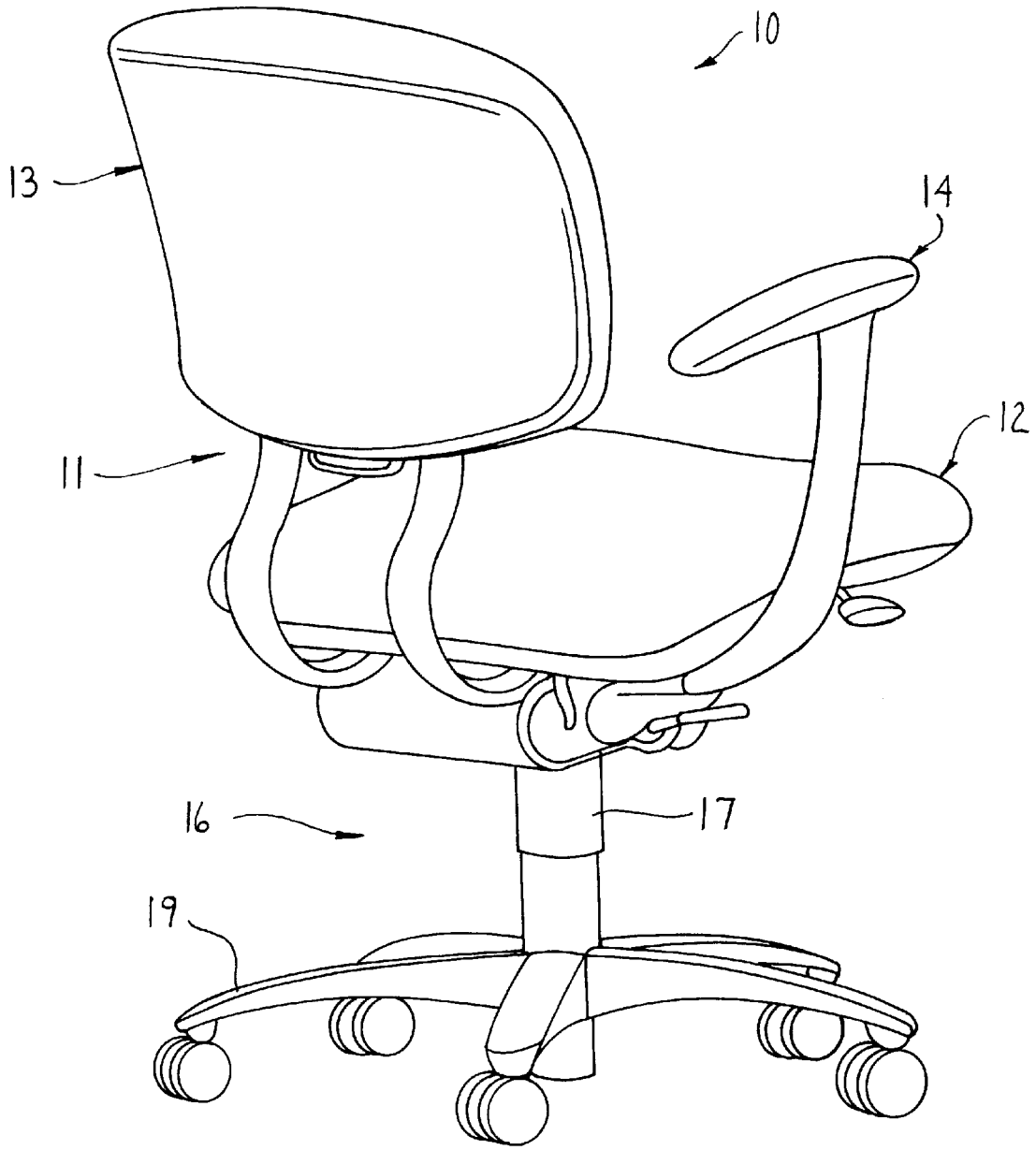
FIG. 1 is a perspective view of a chair according to the present invention.

Certain terminology will be used in the following description for convenience in reference only, and will not be limiting. For example, the words "upwardly", "downwardly", "rightwardly" and "leftwardly" will refer to directions in the drawings to which reference is made. These words will also be used to refer to the same directions experienced by an occupant of the chair. The words "inwardly" and "outwardly" will refer to directions toward and away from, respectively, the geometric center of the chair and designated parts thereof. Said terminology will include the words specifically mentioned, derivatives thereof, and words of similar import.

DETAILED DESCRIPTION

Figure 2:
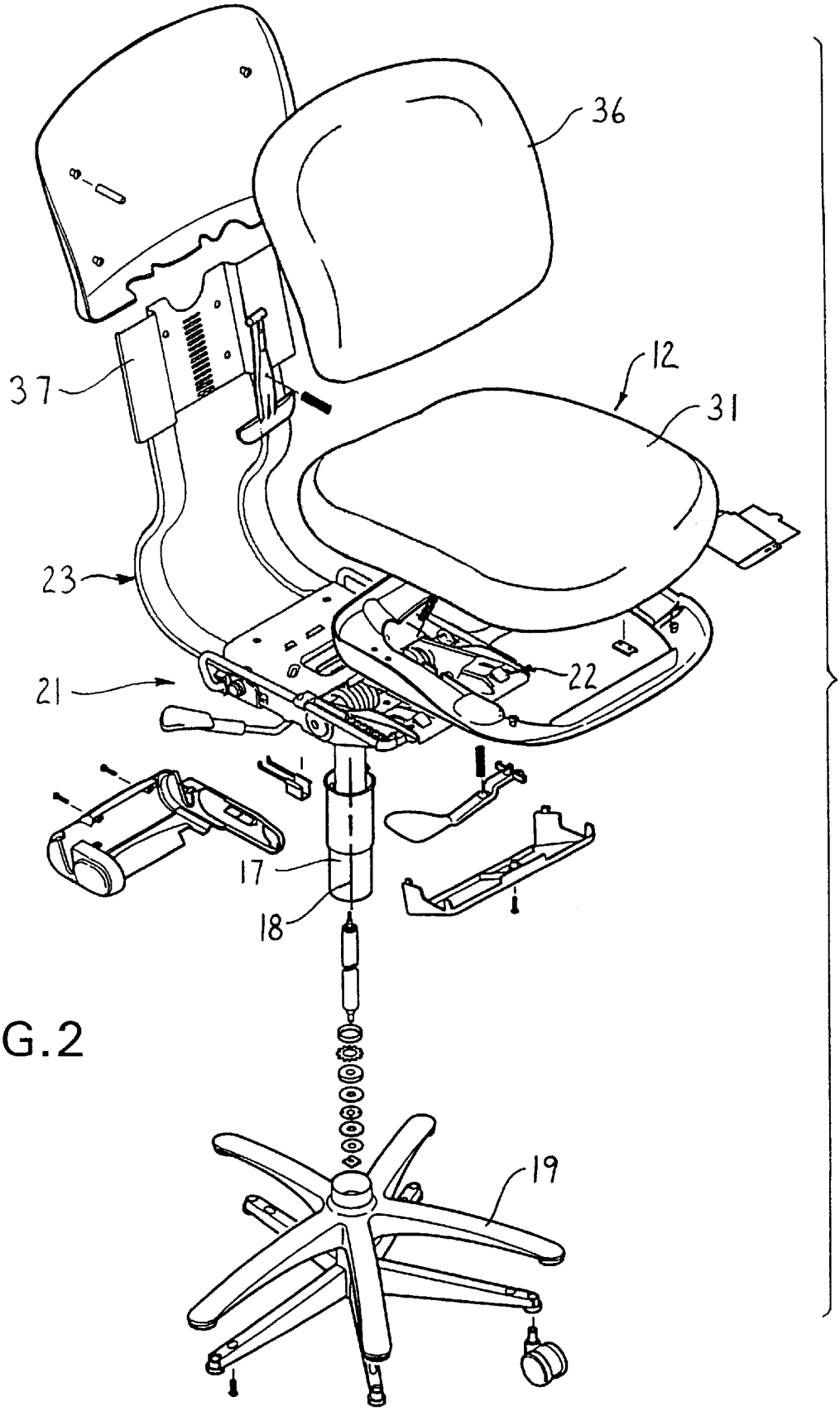
FIG. 2 is an exploded perspective view of the chair.

General Description:

Referring to FIGS. 1 and 2, there is illustrated a chair 10 according to the present invention. The chair, as in generally conventional, includes a generally L-shaped seat-back arrangement 11, with the basic components thereof being a seat assembly 12 and a back assembly 13. In the illustrated embodiments, a pair of arms 14 are disposed adjacent opposite sides of the chair, and are connected to and supported by the seat assembly. The seat-back arrangement 11 is supported on a base arrangement 16 which includes a height-adjustable pedestal assembly 17 which projects generally vertically upwardly and defines a vertical longitudinal axis 18 for the chair. This pedestal assembly 17 has the upper end thereof interconnected to the seat assembly substantially at the middle thereof, and the lower end of the pedestal assembly 17 is secured to a conventional multi-leg base 19, the latter typically being supported on a plurality of casters.

Figure 3:
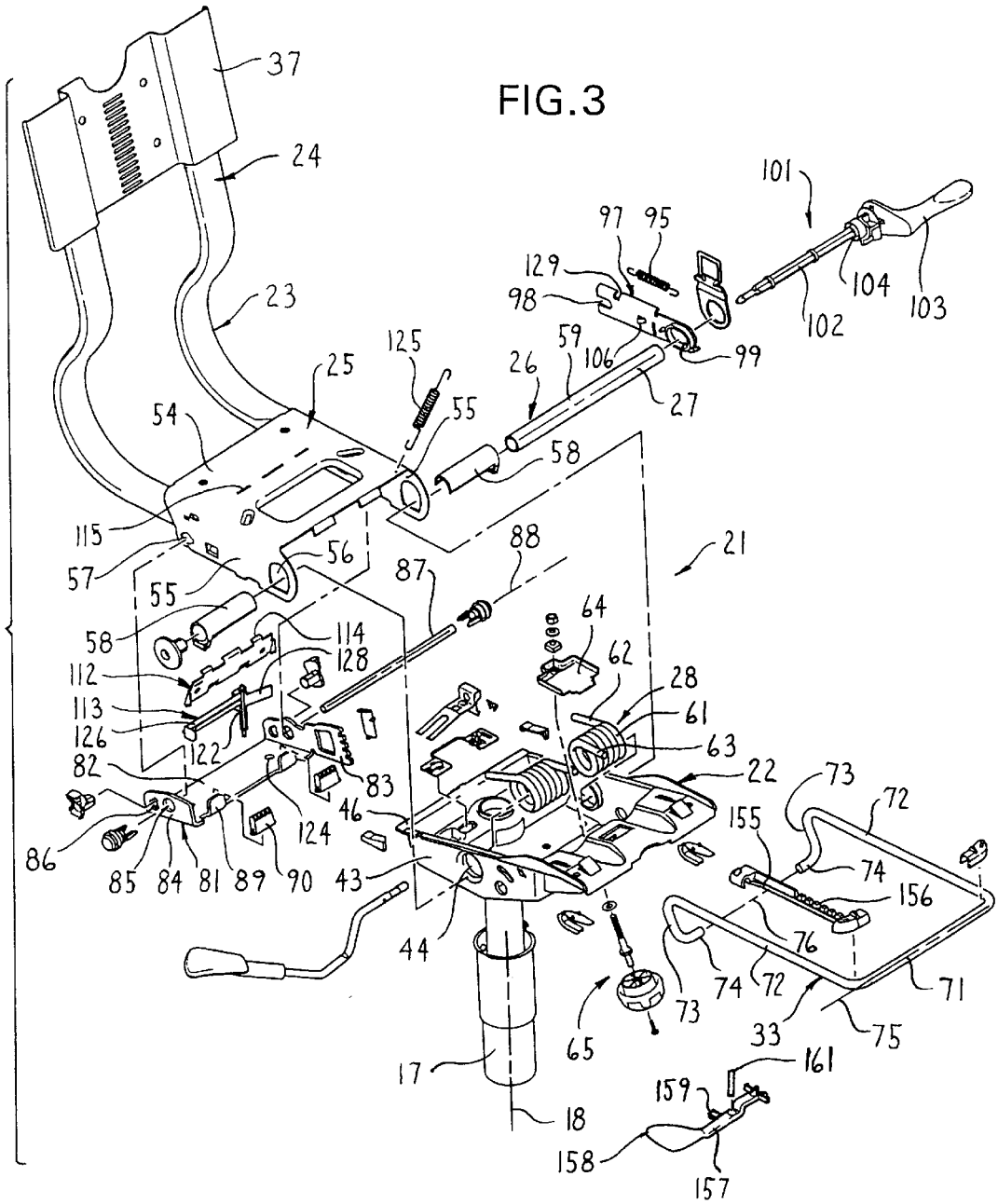
FIG. 3 is an exploded perspective view of primarily the tilt control mechanism.
Figure 4:
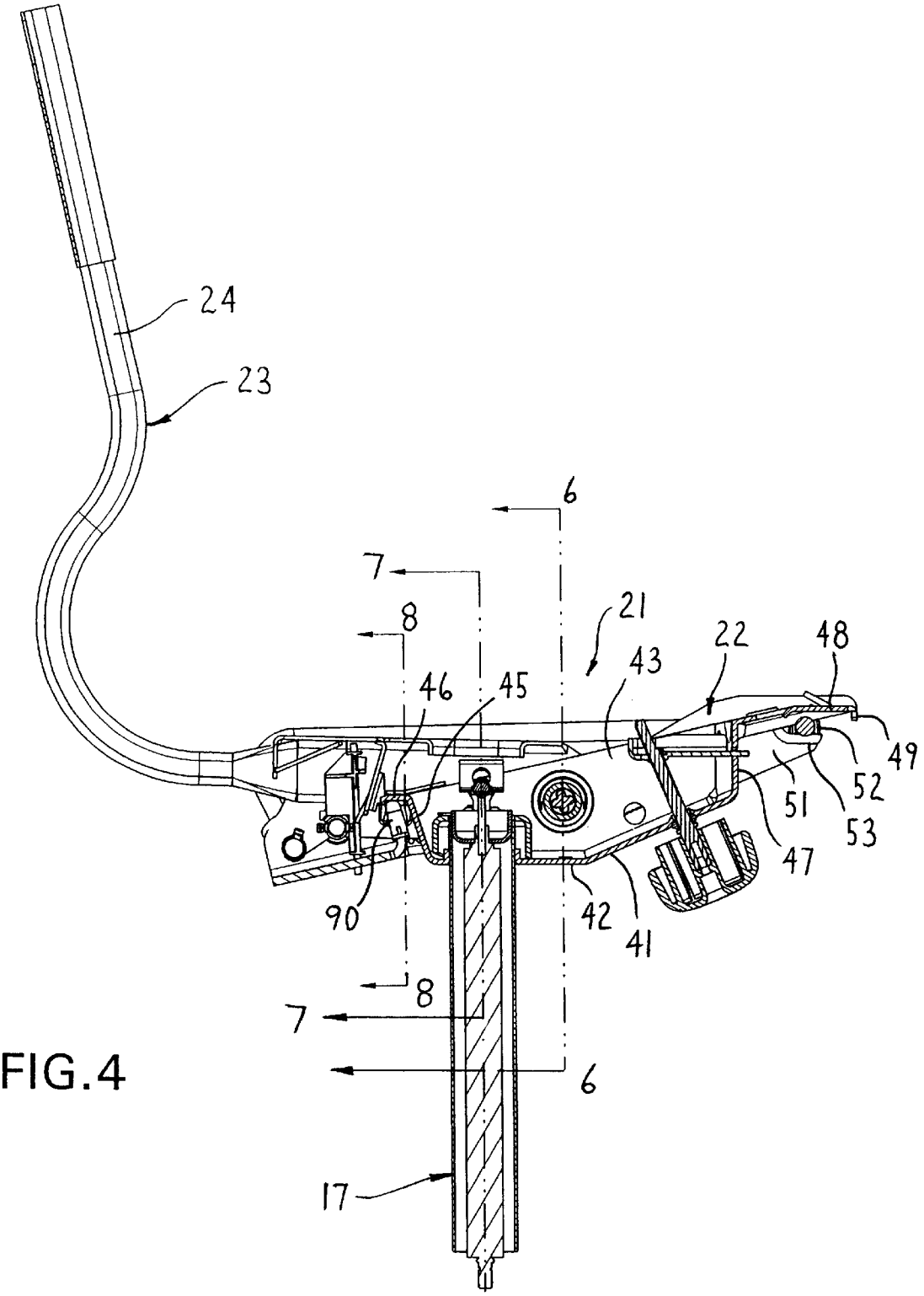
FIG. 4 is a side elevational view taken generally along line 4—4 in FIG. 5 and showing the chair control mechanism mounted on the support pedestal.
Figure 5:
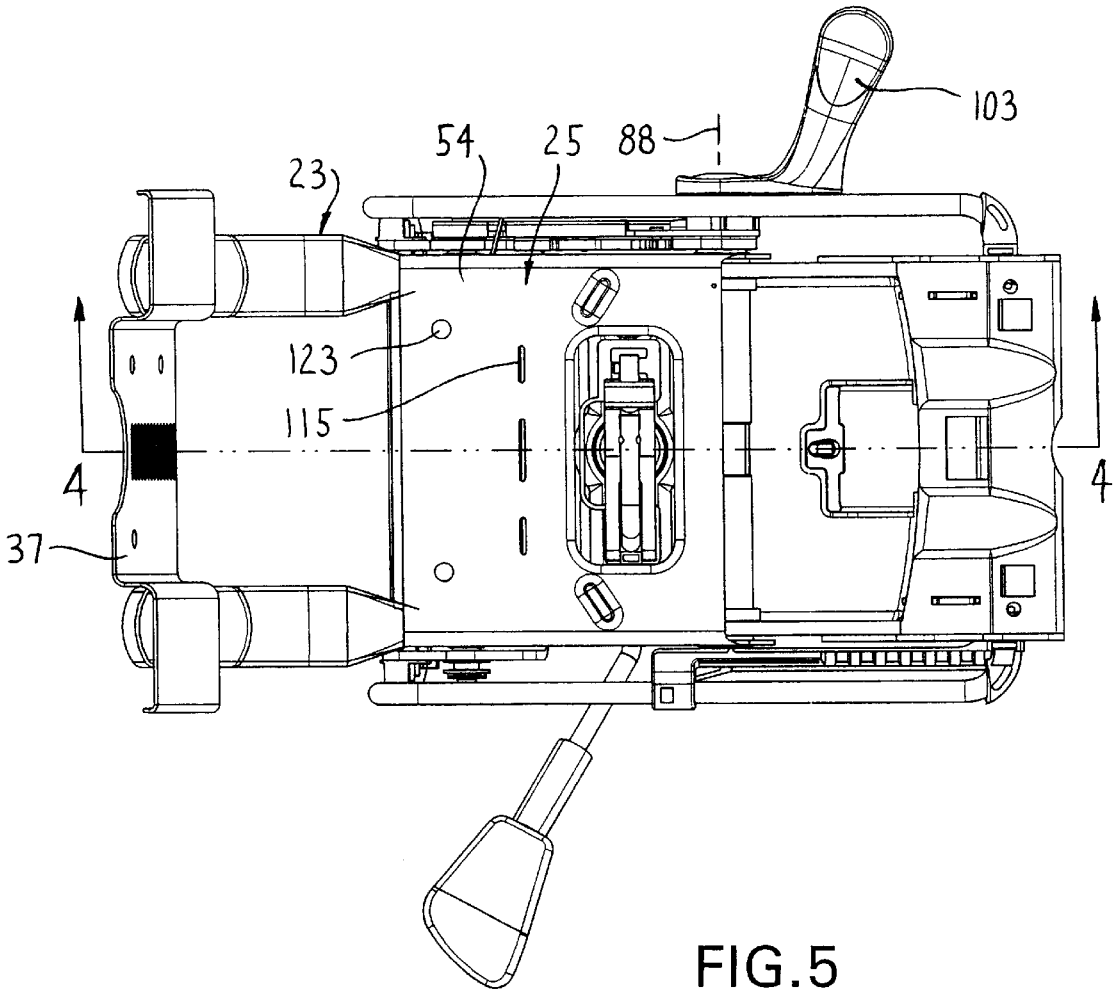
FIG. 5 is a top view of the control mechanism as shown in FIG. 4.
Figure 6:
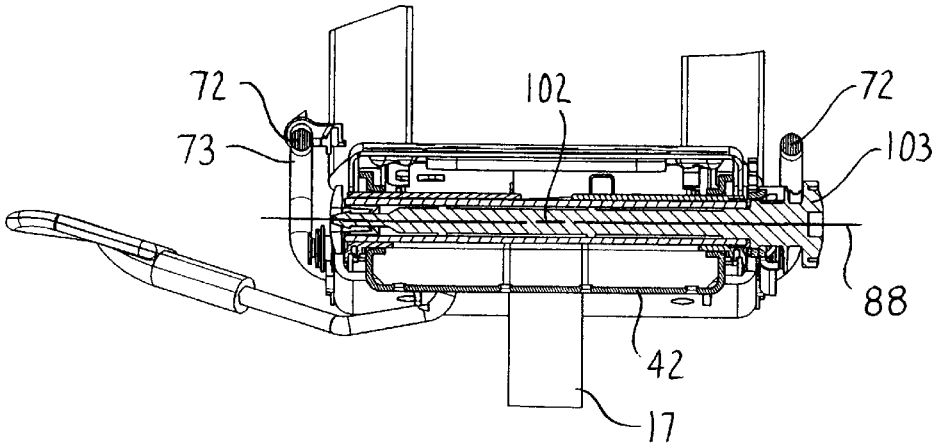
FIGS. 6, 7 and 8 are sectional views taken generally along lines 6—6, 7—7, and 8—8, respectively in FIG. 4.
Figure 7:
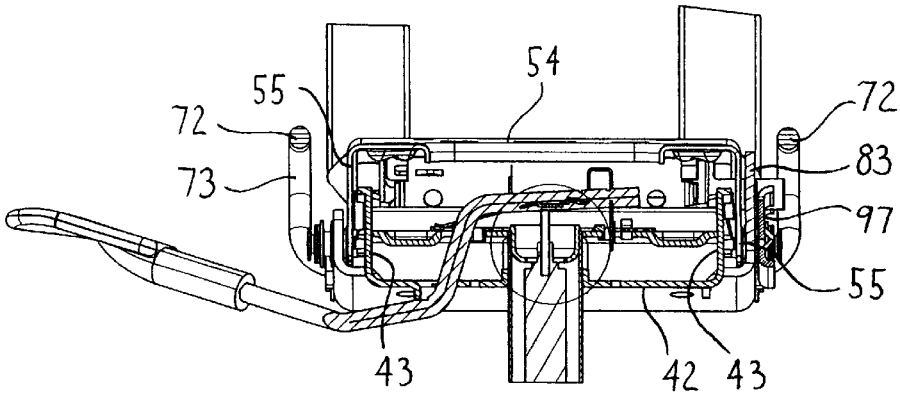
Figure 8:
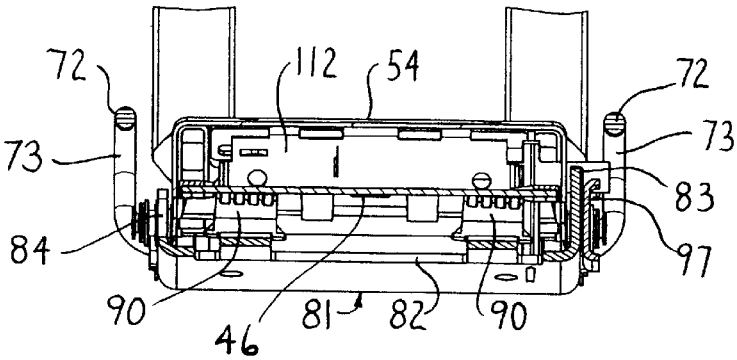
Figure 9:
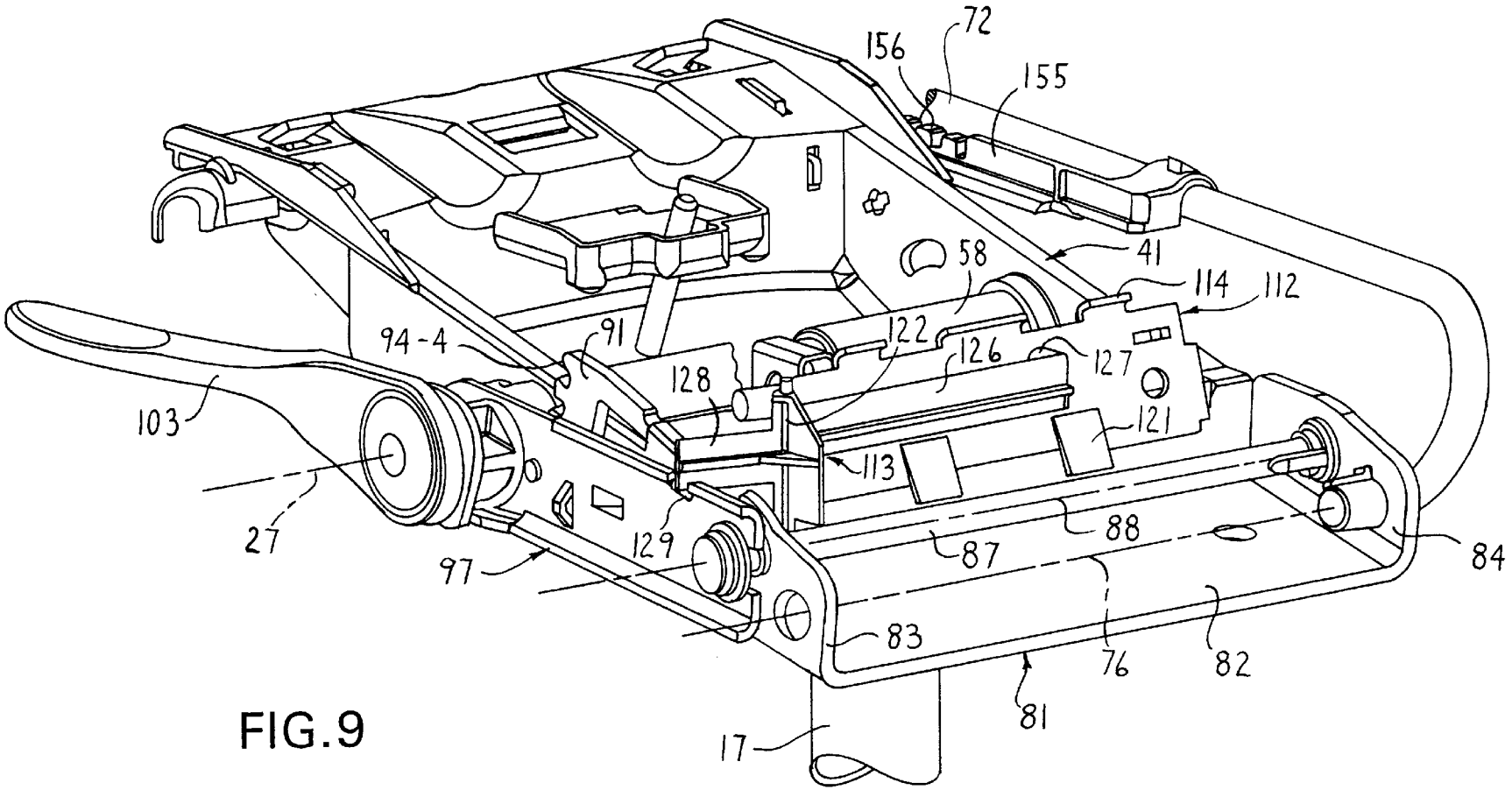
FIG. 9 is a fragmentary perspective view of the chair control to permit illustration of structure interiorly of the control housing.

The seat-back arrangement 11, and its connection to the pedestal assembly 17, includes a chair tilt control mechanism 21 (FIGS. 3 and 4), two primarily components of which are a control body 22 which is fixed to an upper end of the pedestal 17, and an upright 23. The upright 23 is a generally one-piece L-shaped structure having a generally vertical part or leg 24 which projects upwardly for association with the back assembly 13, and a generally base or lower leg part 25 which is joined to the lower end of the vertical part 24 through an elbow or curved portion. This lower leg part 25 of the upright projects generally under the seat assembly 12 and, adjacent the front or free end of the leg part 25, is connected to the control body 22 by a pivot assembly 26 which defines a substantially horizontal pivot axis 27 which is positioned slightly below and extends transversely (i.e. sidewardly) of the seat assembly and is positioned slightly forwardly of the vertical axis 18. A biasing assembly 28 is positioned generally within the control body 22 and coacts between the control body 22 and the upright 23 so as to normally resiliently urge the upright 23 into an upright position as illustrated by FIGS. 2–4, this being the typical upright position of the chair.

In the chair 10, the seat assembly 12 includes a seat member 31 which is typically formed by an upholstered cushion secured to the upper surface of a horizontally enlarged support shell or plate 32 (FIG. 14), the latter typically being of a molted plastics material. The support shell 32 of the seat member 31 in turn is mounted on a seat support member 33 which in turn is mounted on the control mechanism 21. The mounting of the seat member 31 on the seat support member 33 permits occupant-selected sliding and repositioning of the seat member 31 in the front-to-back direction of the chair, as explained hereinafter.

The back assembly includes a back member 36 (FIG. 2) which is also typically defined by an upholstered cushion secured to the front side of a inner support shell or plate, with this back member 36 being interconnected to and vertically movably supported on a mounting plate 37 which is fixedly provided on the upper end of the vertical leg part of the upright 23, with the back member 36 being connected to the mounting plate 37 by means of a height-adjusting mechanism, such mechanism being conventional and well known.

Tilt Control Mechanism:

Considering now the details of the control mechanism 21, and specifically the control body 22, it includes a one-piece cuplike housing 41 which is of a shallow and upwardly-opening configuration. This housing 41 has a bottom wall 42 which is fixed to the upper end of the pedestal 17, and a pair of generally parallel side walls 43 projecting upwardly from opposite sides of the bottom wall. These side walls have horizontally aligned openings 44 formed therethrough for accommodating the pivot assembly 26. A rear wall 45 projects upwardly from the bottom wall and terminates in a top flange 46 which projects rearwardly. A front wall 47 projects upwardly from the bottom wall and is bent outwardly and projects forwardly of the control body over a significant extent so as to define a front lip part 48 which terminates generally in a front edge 49. The housing 41 also has a pair of support flanges 51 which are fixed to the underside of the lip 48 and to the front wall 47. These support flanges 51 are disposed under and adjacent opposite sides of the lip part 48, and each has a horizontally elongate slot 52 formed therein, which slot opens outwardly through the front edge of the support flange 51. The slot 52 is typically provided with a suitable bearing 53, such as of a plastics material, extending along the upper and lower edges thereof.

Considering now the construction of the upright 23, it is formed generally as a one-piece L-shaped weldment and includes the upper and lower leg parts 24 and 25 as briefly described above. The lower leg part 25 has a generally shallow, downwardly-opening, channel-like cross section defined by a top wall 54 which at opposite edges is bent downwardly to define generally parallel side walls 55. These side walls 55, adjacent the forward ends thereof, have horizontally aligned openings 56 therethrough. A further pair of horizontally aligned openings 57 are formed through the side walls 55 adjacent the rearward ends thereof. The channel-shaped configuration of the base part 25 of the upright is such that the side walls 55 closely exteriorly straddle the side walls 43 of the housing 41, with the openings 56 being positioned closely adjacent and substantially coaxially aligned with the openings 44.

The control body 22 and upright 23 are pivotally coupled together by the pivot assembly 26 which, as illustrated by FIG. 3, includes a pair of substantially identical one-piece plastic bearing sleeves 58 which are positioned within the respectively adjacent pairs of aligned openings 44 and 56, and these bearing sleeves 58 in turn support thereon an elongate main support shaft 59, which main shaft 59 is hollow and defines the transverse horizontal pivot or tilt axis 27.

The biasing assembly 28 is positioned generally within the housing 41 and includes a pair of coiled torsion springs 61 which are disposed in surrounding relationship to the bearing sleeves 58. Each torsion spring 61 has an outwardly projecting free arm 62 at one end thereof which projects under and is engaged with the undersurface of the top wall 54 of the upright to continually urge the upright into the normal upright position. Each torsion spring also has a further outwardly projecting free arm 63 at the other end thereof, which arm 63 is maintained in engagement with an adjustment plate 64 which is movably disposed within the housing 41, which adjustment plate in turn is coupled to a manually-actuated adjustment knob assembly 65 so as to enable the torsion of the springs 61 to be initially adjusted. The construction and cooperation of the biasing assembly 28, and the adjustment thereof, is conventional.

To permit the synchronous but differential rearward tilting of the seat and back assemblies, the tilt control mechanism provides for pivotal and slidable support of the front end of the seat support member 33 on the housing 41, and provides for pivotal support of the rearward end of the seat support member 33 on the upright 23.

More specifically, the seat support member 33 in the illustrated and preferred embodiment is formed generally as a horizontally-oriented and rearwardly-opening U-shaped member having a front rod 71 which defines the bight of the U and which extends horizontally and transversely of the seat. This front rod 71 at opposite ends is formed with substantially 90° bends which in turn join to a pair of generally horizontal and parallel side seat-support rods 72 which project rearwardly. These latter side rods 72 at their rearward ends are provided with downward bends which join to rear leg parts 73 which project generally downwardly through a limited extent, and these rear leg parts 73 at their lower ends are joined through inward bends to rodlike horizontal hinge parts 74, the latter being horizontally inwardly projecting cantilevered parts which are disposed in horizontally aligned and opposed relation with respect to one another. The seat support member 33, in the illustrated and preferred embodiment, is formed by being suitably bent from an elongate metal rod of cylindrical configuration.

The front rod part 71 effectively defines a front hinge axis 75 which extends horizontally and transversely in the vicinity of the front edge of the seat assembly, and this front rod part 71 extends between and projects through the horizontal slots 52 formed under the front lip of the housing 41, whereby the front rod part 71 is thus both pivotal and slidable (in the front-to-back direction) relative to the housing.

The side rod parts 72 of the seat support member project rearwardly along the control housing 41 adjacent opposite sides thereof, and the rear leg parts 73 then project generally downwardly in the vicinity of but spaced rearwardly from the rear corners of the control housing 41. The hinge parts 74 as defined on the rear of the seat support member 33 define a rear hinge axis 76 which extends horizontally adjacent the rear edge of the seat in parallel to the front hinge axis 75. These hinge parts 74 are interconnected to the upright 23 through a control linkage 77 which is part of the overall tilt control mechanism 21 and which, as described hereinafter, can be maintained in a released motion-generating position to permit synchronous nondifferential forward tilting of the seat and back, or can be maintained in a locked position to permit differential synchronous rearward tilting of the seat and back.

The control linkage 77 includes, as a primary component, a rocker or bracket 81 which is of a generally upwardly-opening channel-shaped configuration. This rocker 81 is defined by a generally flat bottom wall 82 which, at opposite sides, is joined to generally parallel and upwardly projecting side walls 83 and 84. These side walls 83–84 define therethrough a first pair of generally horizontally aligned openings 85 which are disposed substantially in the middle of the side walls as measured along the front-to-rear length thereof. A further pair of generally horizontally aligned openings 86 are also formed through the side walls 83–84, with these latter openings 86 being disposed adjacent the rearward ends of the side walls.

The rocker 81 is sized and positioned adjacent the rear of the housing 41 so as to be disposed generally below the upright 23, with the side walls 83–84 of the rocker 81 projecting upwardly closely adjacent but exteriorly of the side walls 55 of the upright so as to be disposed in generally straddling relationship therewith. The side walls 83–84 are positioned such that the horizontal transverse openings 85 are positioned adjacent and aligned with the openings 57 formed in the side walls 55, and a horizontally elongate rocker shaft 87 extends transversely across the upright 23 and projects through the aligned openings 57 and 85 to define a fixed pivotal connection between the upright 23 and the rocker 81. Appropriate plastic bushings or the like can be provided within some or all of these latter openings to provide rotative support for the rocker shaft 87. This latter shaft defines a hinge or pivotal axis 88 which extends horizontally and generally perpendicularly (i.e. sidewardly) under the seat at a location disposed rearwardly from the upright pedestal 17, whereby axis 88 is parallel with but generally between the axes 27 and 76.

The rocker 81, adjacent the front edge of the bottom wall 82, has a pair of upwardly projecting tabs 89 which mount thereon stop members 90, the latter typically being constructed of a rather hard elastomeric material. These stop members are disposed to abuttingly engage the underside of the rear flange 46 of the housing 41.

The left side wall 83 of rocker 81 also has an enlarged sector plate 91 which is integral and coplanar with the side wall 83 and projects forwardly toward the main support shaft 59. This sector plate 91 terminates in a generally accurate front edge 92 which is defined generally about the pivot axis 88. This arcuate front edge 92 is provide with a serrated or notched profile extending therealong, which notched profile in the illustrated embodiment is defined by a series of gearlike teeth 93 which are uniformly spaced apart by intermediate tooth-shaped notches 94. The bottom wall of the lowermost notch 94-1 is spaced radially form the rocker axis 88 by a distance which is smaller than the radial distance from the axis 88 to the bottom walls of the remaining notches 94-2, 94-3 and 94-4.

The openings 86 provided at the rear of the side walls 83 and 84 rotatably accommodate therein the rear hinge parts 74 as defined on the rear leg parts 73 of the seat support member 33, thereby defining the horizontal hinge axis 76 which extends transversely of the seat in generally parallel relationship with the axes 27, 75 and 88. The rocker 81 is thus directly hingedly coupled to the seat support member 33 at the axis 76, and is also directly hingedly coupled to the upright 23 about the hinge axis 88.

The control linkage 77 also includes, as a primary component, a control link 97 which cooperates with the rocker 81.

The control link 97 is formed as a generally flat plate or slide which is disposed closely adjacent and in generally overlapping relation to the rocker side wall 83. This control link 97 has an elongate slot 98 formed therein and opening inwardly from the rearward end of the link, which slot extends generally along the longitudinal length of the slot. The projecting end of the rocker shaft 87 is rotatably and slidably disposed within the slot 98.

The other or forward end of control link 97 has a longitudinally elongate slot or opening 99 formed therethrough, which opening accommodates therein an eccentric part of an actuator 101, the latter being manually engageable and operable by the chair occupant and swingable between first and second positions which are generally about 30° apart.

The actuator 101 includes an elongate cylindrical support shaft 102 which projects coaxially into and is rotatably supported within the hollow main support shaft 59. The support shaft 102, at its outer end, has an actuator handle 103 fixed thereto, the latter being formed in the illustrated embodiment as a lever which projects generally radially outwardly from the support shaft and is of a generally L-shaped configuration, having an enlarged paddle or knob part at the outer end thereof. Alternately, the actuator handle 103 can be formed as a knob if desired. This actuator handle 103 is disposed under and adjacent one side of the seat assembly so as to be readily accessible to the chair occupant.

The actuator 101 includes an eccentric 104 which is positioned just inwardly of the handle 103, which eccentric has an exterior configuration which resembles a cylinder but which is eccentrically positioned relative to the pivot axis of the actuator as defined by the support shaft 102. This eccentric part 104 is positioned within the elongate opening 99 defined at the front end of the control link 97 so that, upon rotation of the handle 103 through an angle of about 30° between first and second positions, the eccentric 104 cooperates with the front end of the control link 97 to thus movably displace the control link 97 either forwardly or rearwardly between respective disengaged and engaged positions relative to the rocker 81.

To define the engaged or disengaged relationships, the control link 97 has a lug or pin 106 secured thereto intermediate the ends thereof, which pin 106 projects sidewardly from the inner surface of the link 97 and is positioned so as to be engaged within one of the notches 94 when the control link 97 is in its rearward positions. When so engaged, the control link 97 and rocker 81 are effectively locked together. In contrast, when the control link 97 is in a forward position, then the pin 106 is disengaged from the notches 94 and the rocker 81 is free to pivotally move relative to the control link 97, as explained hereinafter.

The control link 97 has one end of a tension spring 95 secured to a lug provided on a side wall thereof, and the other end of this tension spring 95 is anchored around the projecting end of the rocker shaft 87, which spring 95 always urges the control link 97 towards a rear position.

As explained hereinafter, when the control link 97 is lockingly engaged with the rocker 81, this results in the upright 23 being pivotal about the horizontal pivot axis 27 defined by the main support shaft 59, and the seat support member 33 due to its pivotal connections at the front and rear ends thereof pivots at a different and lesser rate, thereby providing a synchronous differential tilting between the upright and seat support member. On the other hand, when the control link 97 is shifted forwardly into a position of disengagement or unlocking engagement relative to the rocker 81, then the rocker 81 is pivotal relative to the upright 23 and relative to the control housing 41 so that, during forward tilting of the seat assembly, the back and seat both synchronously tilt forward at substantially the same rate.

Forward Tilt Lock:

When the chair 10 is being used in a forward tilt position, it is desirable to be able to lock the seat-back arrangement in the forward tilt position to enable the occupant to carry out some type of high intensity work function. For this purpose, the chair 10 of this invention is provided with a tilt lock mechanism 111 which cooperates between the upright 23 and the rear of the control housing 41. This tilt lock mechanism 111 includes two primary components, one being a lock member 112 and the other being an actuator lever 113.

The lock member 112 is formed generally as a flat plate which is provided with upwardly projecting tabs 114 on the upper edge thereof, which tabs project through elongate slots 115 formed in the top wall of the upright 23, whereby the tabs pivotally suspend the lock plate 112 from the uprights with the lock plate 112 being positioned adjacent but projecting downwardly below the rear free edge of the rear housing flange 46.

The lock plate has flanges 116 which are bent generally at right angles and project forwardly adjacent opposite ends of the lock plate. These flanges 116 define thereon an upper stop surface or shoulder 117 and an intermediate stop surface or shoulder 118. A further lower stop surface or shoulder 119 is defined by the lower edge of the lock plate, the latter shoulder or surface being rearwardly bounded by flaps 121 which are fixed to and project downwardly from the lock plate 112. These shoulders 117, 118 and 119 define a series of three stops which are disposed in a stepped relationship so that the three steps are disposed in vertically and rearwardly spaced sequential relationship. These steps or shoulders 117–119 are adapted to be engaged over the upper edge of the rear housing flange 46 so as to permit the seat-back arrangement to be locked in one of three different forward tilt angles.

The lock plate 112 is normally held in a disengaged or nonlocking position spaced rearwardly from the rear housing flange by a tensioned coil spring 125 connected between the lock plate and the upright.

The movement of and holding of the lock plate 112 in the locked position is controlled by the actuator lever 113. This latter lever 113 includes a generally vertically elongate pivot shaft 122, the upper end of which is pivotally supported in an opening 123 formed in the top wall of the upright 23, and the lower end of which is rotatably supported in a further opening 124 formed in the bottom wall of the rocker 81. The actuator lever 113 has a first arm 126 which is cantilevered radially outwardly from the pivot shaft 122 so as to project into the region behind the lock plate 112. This arm 126 at its free end is provided with a forwardly projecting end part 127 which is adapted to engagedly contact a rear surface of the lock plate 112. A further arm 128 projects radially outwardly from the other side of the pivot shaft 122 and, in the vicinity of the free end thereof, is engaged within a notch 129 defined in the upper edge of the control link 97. Due to this latter relationship, when the control link 97 is in its full rearward position wherein the pin 106 is fixedly engaged within one of the deep notches 94-2, 94-3 or 94-4 of the rocker 81, the arm 126 is pivoted forwardly so that the end part 127 thereof is engaged with the lock plate 112, thereby pivotally urging the lock plate forwardly so that the stop surfaces 117–119 thereof are positioned for appropriate engagement with the upper edge of the rear housing flange 46.

Figure 13:
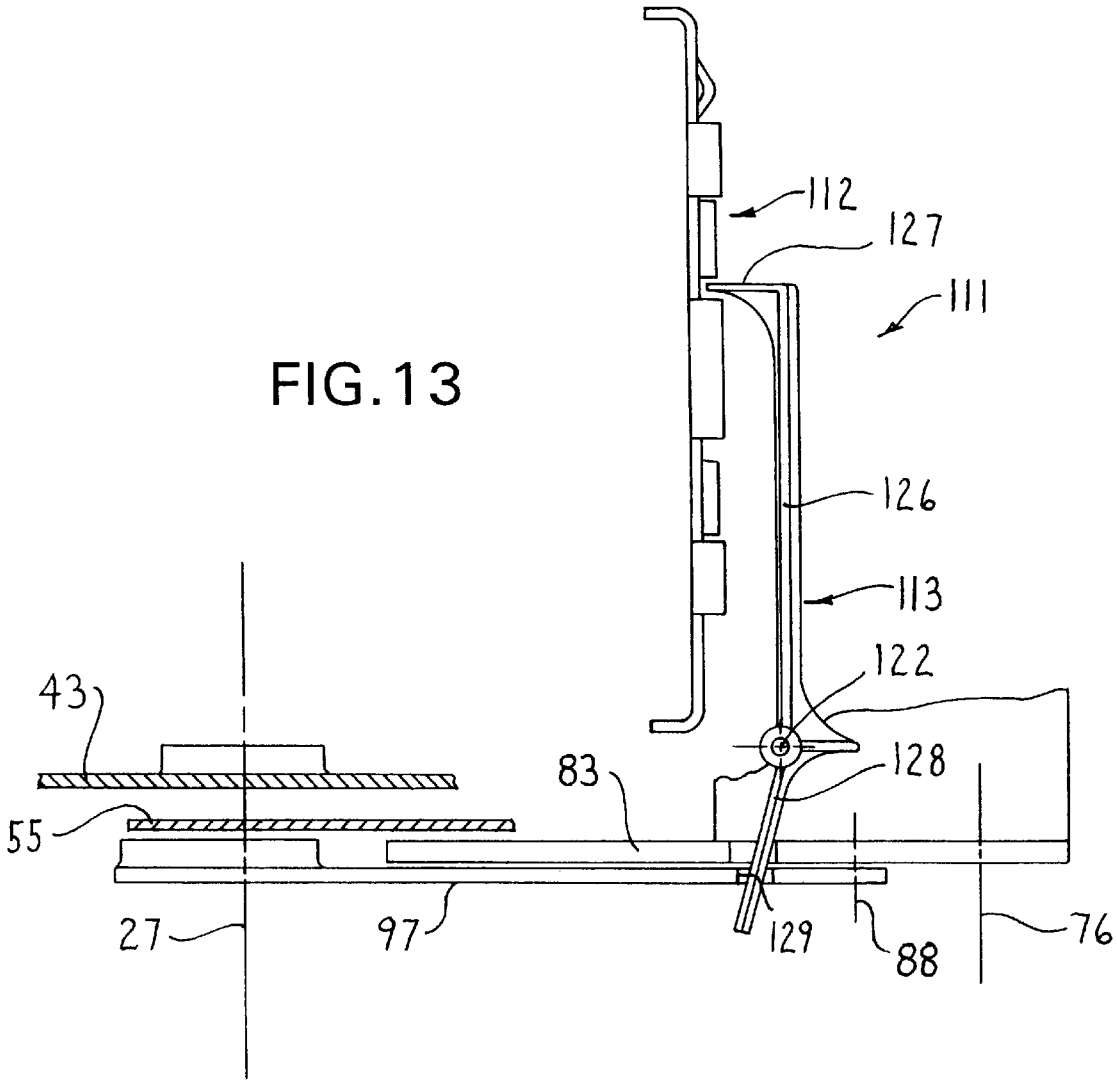
FIG. 13 is a fragmentary top view showing the relationship between the forward tilt control and the tilt lock mechanism.

Sliding Seat Assembly:

As briefly noted above, and referring to FIGS. 14–18, the seat assembly 12 includes a seat member 31 defined by an upholstered cushion supported on a shell or plate 32, the latter being slidably supported on the seat support member 33 (FIG. 13). The slidable support of the seat member 31 on the seat support member 33 will now be described.

Figure 14:
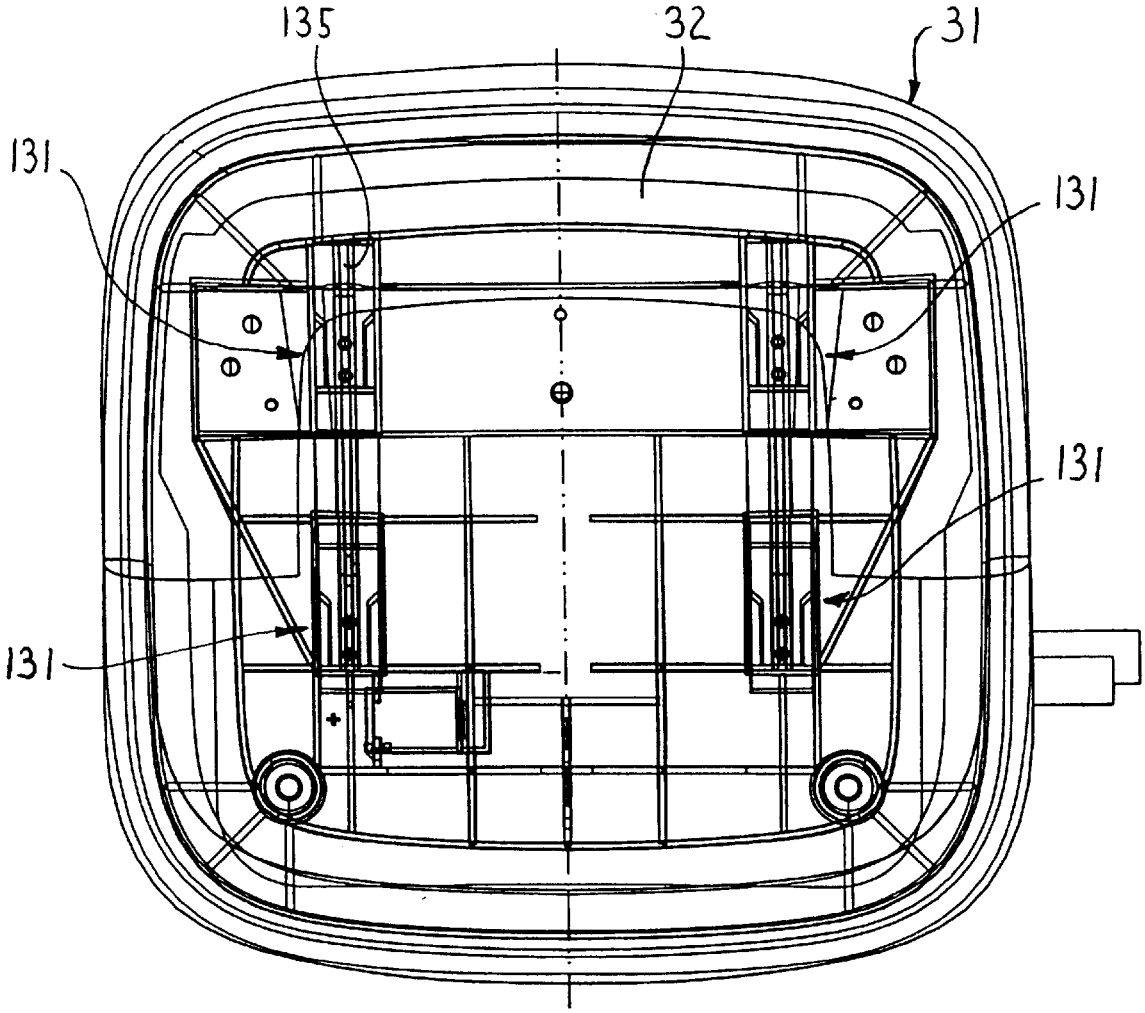
FIG. 14 is a bottom view of the seat member.
Figure 15:
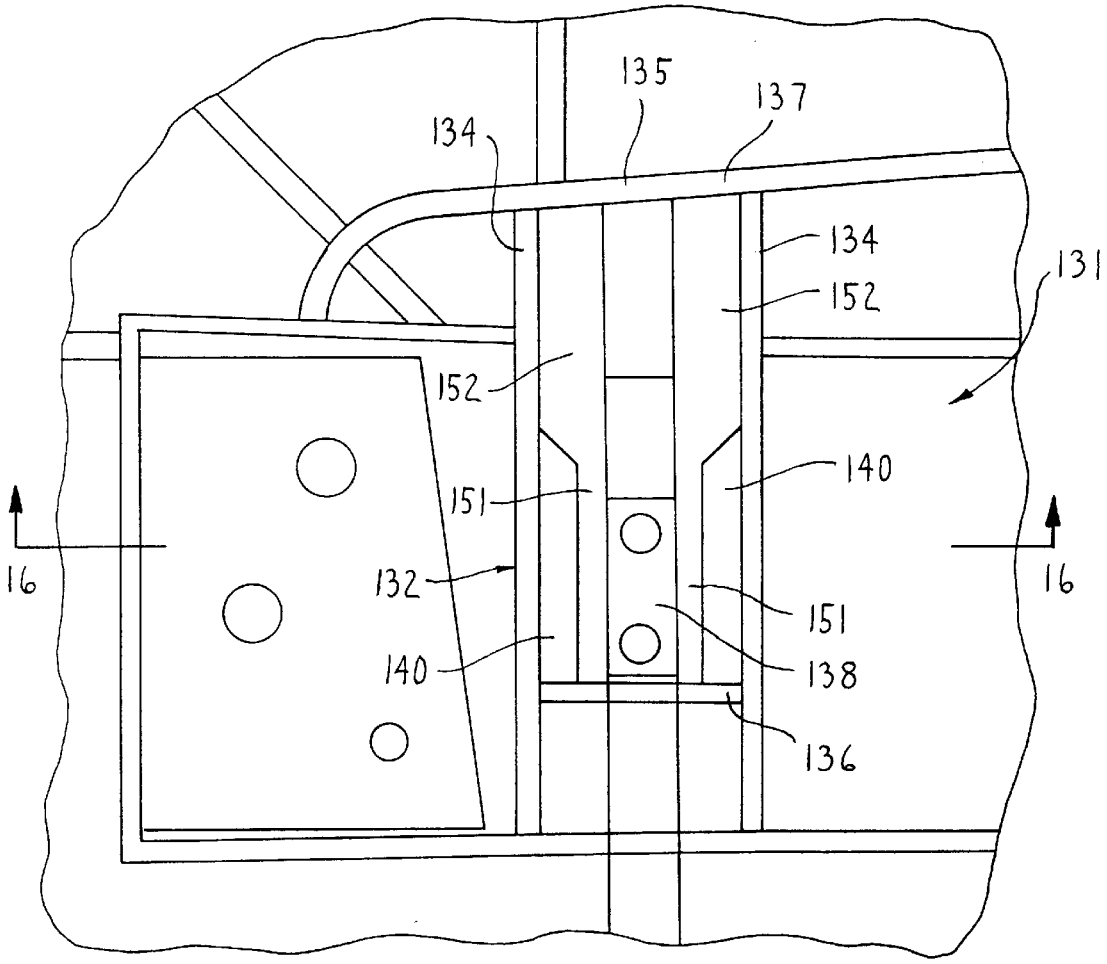
FIG. 15 is an enlargement of a portion of FIG. 14, which enlargement specifically illustrates one of the attachment points on the seat shell for attachment to the seat support member.

As illustrated by FIG. 14, the seat support shell 32 has four mounting locations 131 defined on the underside thereof, which four locations being disposed generally and individually in close relationship to the four corners of the seat shell. Two such locations 131 are defined adjacent each side edge of the shell, with the two locations on each side edge being disposed in aligned front-to-back spaced relationship. One of the mounting locations 131 is illustrated on an enlarged scale in FIGS. 15–17.

The mounting location 131 includes a generally downwardly-opening channel-shaped structure 132 which extends in the front-to-back direction of the seat and is defined by a base wall 133 joined between a pair of generally parallel and sidewardly spaced side walls 134 which project downwardly. A central support rib 135 is fixed to the base wall 133 and projects downwardly therefrom in parallel but generally spaced relationship between the side walls 134. The rib 135 and the parallel side walls 134 extend in the front-to-back direction through a significant distance, and connect to generally parallel front and back transverse walls 136 and 137, respectively.

The rib 135, adjacent the front transverse wall 136, fixedly mounts thereon a slide bearing 138 which projects only a small distance toward the rear transverse wall 137 and defines thereon a downwardly-facing concave bearing surface 139 which is generated on a radius which substantially equals the radius of the side rod 72 of the seat support member 33, whereby the side rod 72 is maintained in relative sliding engagement with the bearing 138.

The support channel 132 defining the mounting location 131 also has a pair of retaining flanges 140 associated therewith, which flanges 140 project horizontally inwardly toward one another in downwardly spaced relation from the bottom wall 133. These flanges 140, however terminate in sidewardly spaced relation from the rib 135 which is positioned therebetween so as to define a clearance space 151 between the rib 135 and each of the retaining flanges 140. These retaining flanges 140 also extend over only a part of the length of the support channel 132, with the flanges 140 specifically extending from a location adjacent the front transverse wall 136 and then projecting rearwardly therefrom only partway toward the rear transverse wall 137. The retaining flanges 140 are thus disposed so as to extend generally parallel with the bearing 138 and extend over generally a similar length. The narrow clearance spaces 151 as defined between the retaining flanges 140 and the rib 135 open into wider clearance spaces 152 which are defined between the rib 135 and the side walls 134 adjacent the rearward end of the support channel 132.

To vertically fixedly captivate the seat member 31 to the seat support member 33 while permitting relative front-to-back sliding movement therebetween, there is provided a removable retainer or clip 141 for vertical structural connection between the support channel 32 on the seat shell, and the slide rod 72, as illustrated by FIGS. 16–18. The retainer 141 includes a main channel-shaped body part 142 having a base wall 143 and a pair of upwardly cantilevered side walls or legs 144, the latter preferably being of a slightly diverging relationship as they project away from the base wall so as to terminate in an open mouth. These side legs 144, at their free ends, are provided with outwardly projecting retaining tabs 145 which extend longitudinally along the length of each side leg 144.

The retainer 141 also has a pair of elongate fingers 146 which are individually fixed to a respective one of the side legs 144, with each finger 146 then projecting longitudinally outwardly in a cantilevered fashion away from the main body part 142 so as to terminate in an upwardly projecting lug 147 which defines the free end of the respective finger. These fingers 146 join to the side legs 144 adjacent the upper free edges thereof, and they are individually resiliently flexible inasmuch as the entire retainer 141 is preferably constructed of a material having at least limited elasticity, such as a plastic material.

To secure the seat member 31 to the seat support member 33, the seat member 31 and seat support member 33 are relatively positioned in engagement so that the front and rear bearings 139 adjacent each side of the seat shell 32 are disposed in supportive engagement with the respective side rod 72, such as illustrated in FIG. 16. A clip or retainer 141 is then applied to each mounting location 131 so as to vertically secure the respective bearing 139 and side rod 72 in vertically restrained yet horizontal sliding engagement with one another. For this purpose, the retainer 141 is oriented so that the body part 142 is positioned with the side legs 144 thereof generally vertically aligned with the enlarged clearance channels 152, and with the flexible fingers 146 projecting rearwardly over the rear transverse wall 137. The body part 142 is then angled downwardly to insert the leading ends of the retaining tabs 145 downwardly into the channels 152, and the retainer 141 is then relatively moved forwardly along the support channel 132 until the retaining tabs 145 move under the leading ends of the retaining flanges 140. The main body 142 of the retainer 141 is then slidably moved forwardly along the retaining flanges 140, and during this forward movement the resilient fingers 146 are vertically deflected by the transverse wall 137. When the main body 142 of the retainer effectively reaches the front transverse wall 136, the lugs 147 at the free ends of fingers 146 have now passed over the rear wall 137 and resiliently deflect or snap back into a generally straight position such that the lugs 147 are now disposed directly in front of the rear transverse wall 137, thereby preventing either front or rear slidable displacement of the retainer 141 without first effecting deflection of the fingers 146 so as to effect their release from the rear wall 137. In this fashion, the retainers effect a resilient snaplike engagement with the channel structures 132 so as to fixedly vertically restrain and maintain a horizontal sliding engagement between the side rods 72 and the plastic bearings 139 provided on the seat shell, substantially as illustrated by FIG. 16.

The seat assembly also includes an occupant-releasable latch assembly 154 which cooperates between the seat member 31 and the seat support member 33. This latch assembly includes a generally horizontally elongated position adjustment bracket 155 which is formed generally as an elongate rodlike member having a series of upwardly projecting teeth 156 defined longitudinally along the upper surface thereof. This position adjustment bracket 155 is mounted on the seat support member 33 in closely adjacent but parallel and slightly inwardly spaced relationship from one of the side rods 72, with the adjustment bracket 155 preferably being disposed adjacent the front half of the respectively adjacent side rod 72. The latch assembly 154 also includes a manually actuatable latch lever 157 which is disposed under and projects sidewardly of the seat so as to provide a manually accessible handle 158 at the free end thereof, which handle is disposed on one side of the seat adjacent a front corner thereof for convenient access by the occupant. This handle 158 at its inner end is pivotally supported on the seat shell and, at an intermediate location, is provided with a downwardly projecting latch lug 159 for engagement with the teeth 156 provided on the position adjusting bracket. A conventional coil spring 161 is positionally engaged between the bottom side of the seat shell and the latch lever for normally urging the latch lever 157 downwardly into a latched position wherein the latch lug 159 engages the teeth 156. The occupant then engages the handle 156 to swing the latch lever 157 upwardly out of engagement with the teeth 156 when forward or rearward sliding of the seat is desired, following which the occupant releases the latch lever and the spring surges the latch lever downwardly so that the latch lug 159 again engages the latch teeth 156.

Operation:

The operation of the chair 10, specifically the rearward and forward tilt features thereof, and the locking of the chair in the forward tilt position, will now briefly described to ensure a complete understanding thereof.

Figures 10, 11:
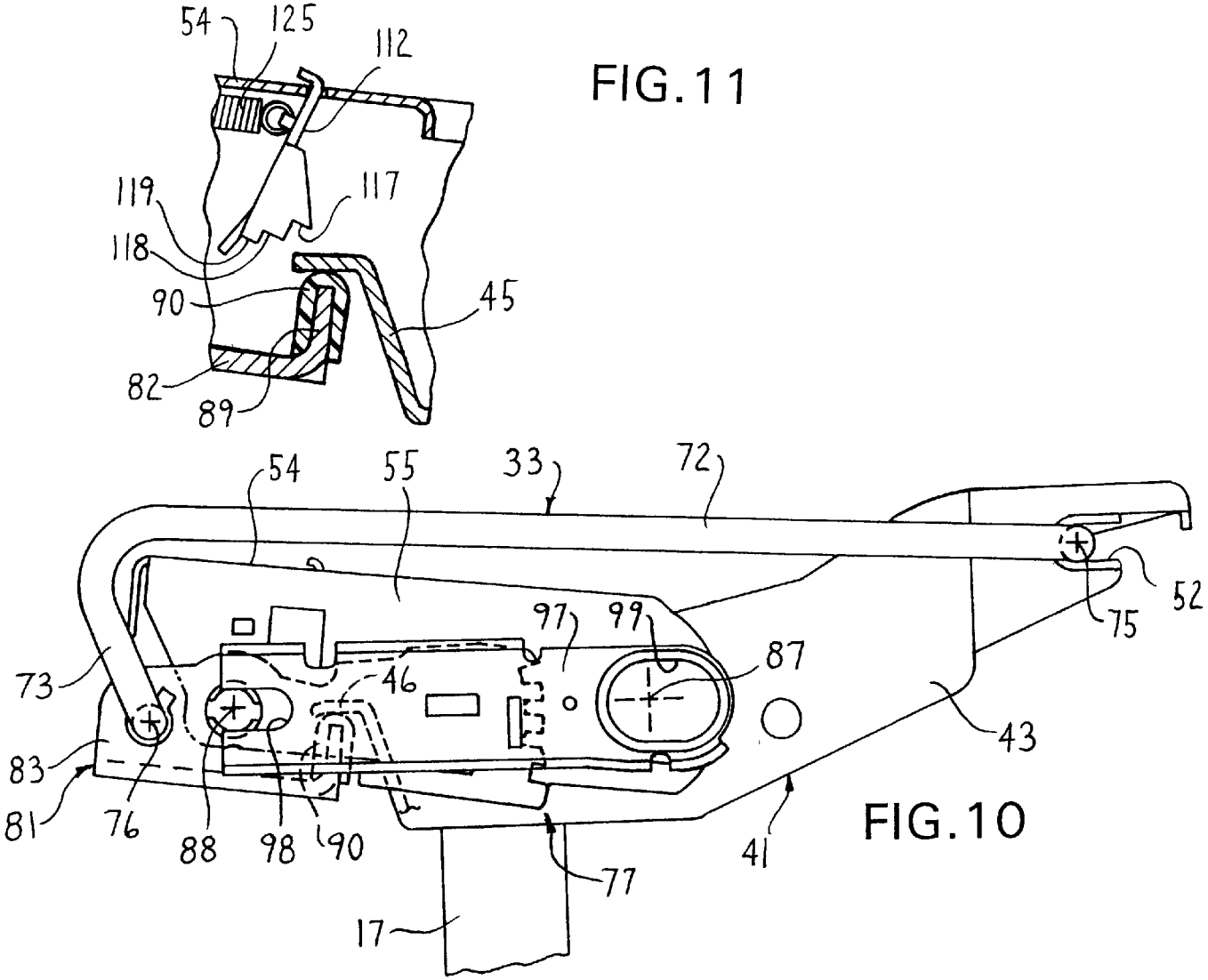
FIG. 10 is a side elevational view of the chair control as shown in FIG. 9.
FIG. 11 is an enlarged fragmentary side view of the tilt lock.
Figure 12:
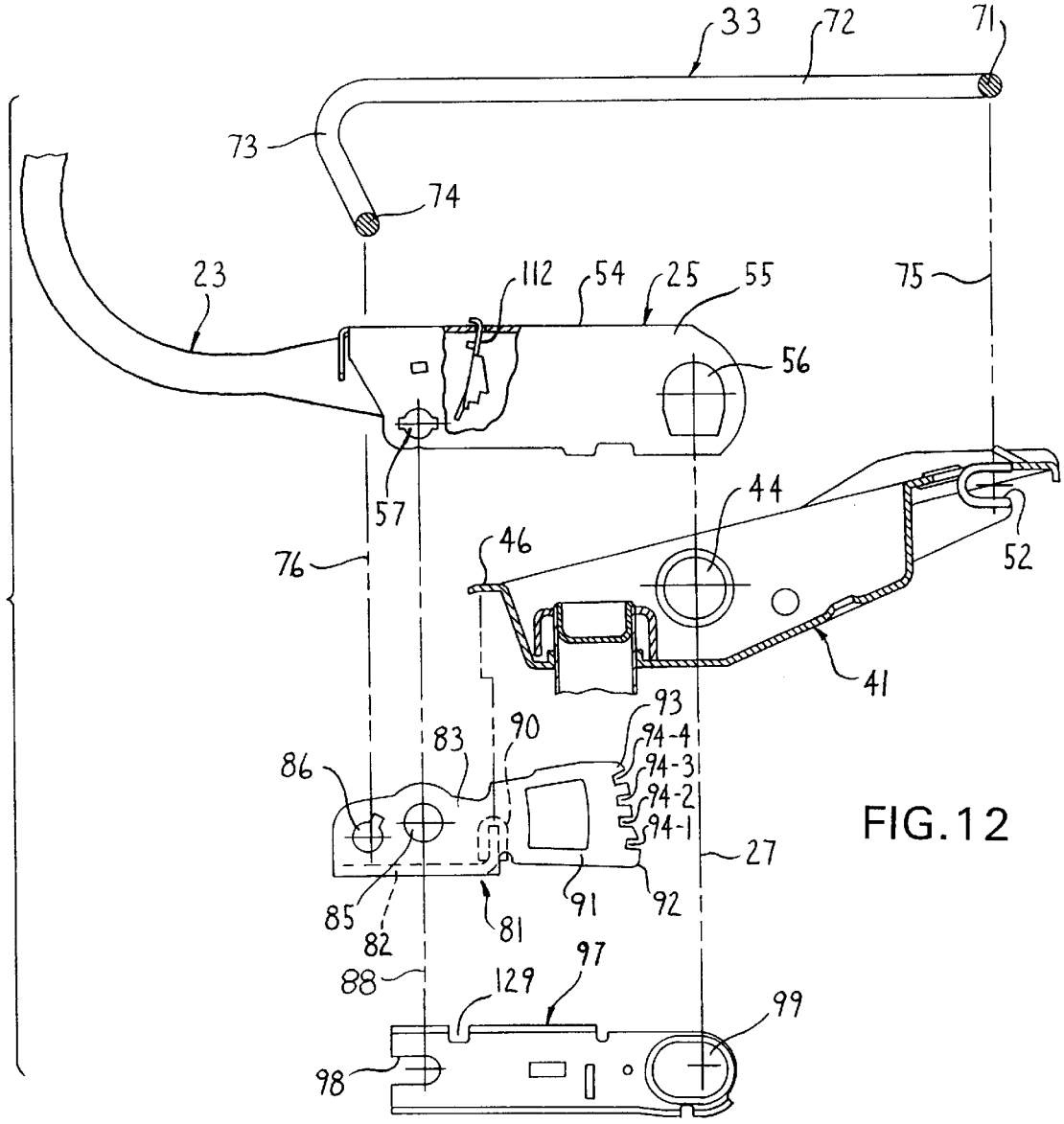
FIG. 12 is an exploded side view of the components shown in FIG. 10.

The chair 10 will normally be maintained in its upright position, and the control linkage 77 will also be normally maintained in an engaged or locked position as illustrated by FIG. 10, in which position the lug or pin 106 on control link 77 is engaged with the lowermost notch 94-1 on the rocker 81 so that the control link 97 and rocker 81 are rigidly joined together and are also effectively nonmovably joined to the upright 23 so as to effectively pivot with the upright as a unitary structure. When the upright 23 is in an upright position and the control linkage 77 is locked, the stops 92 provided on the rocker 90 are normally positioned substantially in abutting engagement with the underside of the rear housing flange 46.

If the chair occupant wishes to utilize the chair for a normal synchronized differential rear tilt function, the occupant will sit in the chair and push his back rearwardly against the seat back so as to cause the upright 23 to pivot rearwardly about the main support axis 27 against the resilient urging of the torsion spring 61. As the upright 23 pivots rearwardly about the axis 27, the rear of the seat support member 33 is moved downwardly inasmuch as the rear of the seat support member is joined at hinge axis 76 to the rocker 81, thus causing the seat support member 33 and the seat 31 mounted thereon to hinge downwardly about the front hinge axis 75. In the illustrated and preferred embodiment, the spacing between the axes 75 and 76 is about twice the transverse spacing between the axes 27 and 76, whereby the back and seat undergo synchronous but differential tilting movements, with the rearward tilting movement of the upright 23 being about twice the downward tilting movement of the seat support member 33. This synchronous but differential rearward tilting between the seat and back thus permits the inclined angle between the seat and back to increase or open up during rearward tilting so as to improve occupant comfort, such being a conventional feature of many office-type chairs. When the occupant-imposed external force urging the chair back rearwardly is relieved, then the torsion springs return the seat-back arrangement to the conventional upright position, the latter again being defined by the stops 90 on the rocker 81 abutting the undersurface of the rear housing flange 46.

With the chair in the conventional upright position as described above, and the control linkage 77 in a locked relationship so as to permit differential synchronous rearward tilting, the pin 106 on the control link 97 is engaged in the lowermost notch 94-1 which is the shallow notch in that its bottom surface is spaced radially a greater distance from the rocker axis 88 then are the bottoms of the remaining deeper notches 94-2 through 94-4. In this normal or conventional position, the control link 97 is maintained generally in an intermediate front-to-back position, being urged in this position by the spring 95. At the same time, the engagement of the arm 128 of the tilt lock actuator lever 113 with the control link 97 is such that the actuator lever 113 is also maintained in a generally central or neutral position so that the arm 126 thereof is spaced just rearwardly of the tilt lock plate 112 with the latter being maintained in an open or unlocked position due to the urging of the spring 125.

When the occupant wishes to effect tilting of the seat-back arrangement forwardly from the normal upright position, the occupant will engage the actuator handle 103 so as to effect rotative displacement of the actuator 101 and of the eccentric 104 thereon through an angle of about 30° about the rocker shaft axis 88. This causes the eccentric 104 to engage the front end of the opening 99 and causes the control link 97 to be pulled forwardly against the urging of the spring 95 so that drive lug 106 is withdrawn from the lowermost notch 94-1.

If the occupant then leans forwardly in the chair, this forward leaning movement in conjunction with the torsion springs 61 cause the back upright 23 to pivot forwardly (clockwise in FIG. 4) about the main horizontal pivot axis 27. This forward pivoting of the upright 23 causes the hinge axis 88 for the rocker support shaft to also move upwardly. However, since the stops 90 on the rocker 81 are positioned in abutting engagement with the undersurface of the rear housing flange 46, and the rocker 81 is also no longer locked to the upright by the control link 97, the rocker 81 hence pivots relative to the upright about the rocker shaft axis 88 as the upright 23 pivots forwardly due to the reaction of the stops 90 against the rear housing flange 46. This causes the rear end of the rocker 81, and specifically the rear hinge axis 76 of the seat support member 33, to move upwardly during the forward tilting of the upright 23. The upward displacement of the rear seat support hinge axis 76 includes two components of movement, one being due to the upward lifting of the rocker hinge axis 88 due to the forward tilting of the upright 23, and the other being due to the hinging or pivoting of the rocker 81 about the rocker shaft axis 88 relative to the upright 23 as caused by the stationary engagement of the stops 90 against the housing flange 46. Due to the distance ratio defined between the various pivot and contact points, the rear hinge axis 76 for the seat member moves upwardly by a distance which is approximately twice the upward displacement of the rocker shaft axis 88, whereby when the upright 23 is titled forwardly through a selected angle, the seat support member 33 is also tilted upwardly (and hence forwardly) about the front axis 75 through substantially the same selected angle. The seat and back thus effectively move synchronously but without any significant differential movement therebetween, whereby the normal angle between the seat and back when in the upright position is maintained when the seat-back arrangement is moved into a forward tilt position.

When the seat-back arrangement is being tilted forwardly, this causes the rocker 91 to pivotally move about the rocker shaft axis 88 relative to the upright 23 but in the same direction, that is, the rocker 81 moves through a forward tilt angle which is greater than the forward tilt angle of the upright 23. This thus causes the remaining notches 94-1, 94-2, and 94-3 to progressively move downwardly into a position of alignment with the locking lug 106 as the forward tilt angle progressively increases. Accordingly, when the operator reaches the desired forward tilt angle (such as about 1.7°, 3.3° or 5°) and wishes to maintain it, then the occupant releases the actuator handle 103 and spring 95 pivotally returns the actuator and moves the control link 97 away from its disengaged position, whereupon the spring 95 urges the control link 97 rearwardly so that the lock pin 106 thereon engages within an appropriate one of the deep notches 94-1, 94-2 or 94-3 when appropriate alignment is achieved. This thus locks the linkage 97 relative to the upright 23 to prevent further tilt in a forward direction. At the same time, the tilt lock mechanism 111 automatically effects locking to prevent rear tilting of the chair away from the selected forward tilt position.

More specifically, when the occupant releases the control linkage 77 as described above, the full rearward displacement of the control link 97 as the lug 106 engages one of the deep notches 94-1 through 94-3 causes rearward displacement of the arm 128 of actuator lever 113, thus causing a corresponding rotation of the pivot shaft 122 which in turn causes the arm 126 to swing forwardly so that the free end 127 thereof abuts the rear of the lock plate 112 and causes the latter to pivot forwardly against the urging of spring 125 for contact with the rear edge of the rear housing flange 46. Accordingly, one of the steps or shoulders 117, 118, 119 on lock plate 112 moves over and engage the upper surface of the rear housing flange 46 to lock the chair against rear tilt. The three notches 94-2 through 94-4 and the three lock steps 117–119 respectively correspond so as to permit the chair, in a forward tilt position, to be locked in a selected one of three different forward tilt angles.

When release from the locked forward tilt position is desired, the occupant again engages the actuator handle 103 and shifts the control link 97 forwardly which in turn pivots the actuator lever 113 so that the arm 126 thereof is moved rearwardly away from the lock plate 112, and the spring 125 then pivots the lock plate rearwardly out of engagement with the housing flange 46 so that the seat-back arrangement can again tilt rearwardly back to its normal upright position.

When the occupant additionally wishes to change the front-to-rear position of the seat member 31 relative to the back, then the occupant merely grasps the latch lever 157 and pushes it downwardly to disengage the latch lever from the adjacent bracket 156, following which the occupant will push the seat either forwardly or rearwardly along the side rods 72 to the desired position. The latch lever will then be released so as to reengage the teeth on the adjustment bracket and accordingly lock the seat member in the newly selected position.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In an office-type chair having a base provided with an upwardly-projecting pedestal assembly, a housing mounted on said pedestal assembly adjacent an upper end thereof, and a seat-back arrangement supported on and interconnected to said housing, said seat-back arrangement including a seat assembly which is disposed above said housing, and means interconnecting said seat assembly to said housing for permitting sliding positional adjustment of the seat assembly relative to the housing in a front-to-back direction of the chair, the improvement comprising a seat support means mounted on said housing and including a pair of generally parallel and elongated support rods positioned under said seat assembly adjacent opposite sides thereof and projecting generally parallel to said direction, said seat assembly including a seat member having a plurality of slide bearings mounted on an underside thereof and disposed in supportive and sliding engagement with said support rods, and a plurality of resilient retainers disposed in stationary and releasable engagement with an underside of said seat member by means of a resilient snap-type fit, each said retainer having a body portion which extends generally around an underside of a respective said support rod for vertically securing said seat member to said support rods.

2. A chair according to claim 1, including manually-releasable latch means cooperating between said seat member and said seat support member for stationarily maintaining the seat assembly in a selected position, said latch means including a manually-engageable latch member which is manually movable into a release position for permitting slidable displacement of the seat member along said direction.

3. A chair according to claim 1, wherein said seat support means comprises a generally one-piece rodlike member deformed into a generally horizontally-opening U-shaped configuration so as to define a front generally horizontally extending cross rod which is disposed adjacent a front edge of said seat member and which at opposite ends is integrally joined to said support rods which project generally horizontally rearwardly adjacent opposite sides of the seat assembly to a position adjacent a rear edge of said seat assembly.

4. A chair according to claim 3, wherein said front cross rod is pivotally supported on said housing, and wherein said side support rods adjacent rear ends thereof are provided with generally horizontally aligned and opposed cantilevered hinge parts which are pivotally interconnected to said seat-back arrangement.

5. A chair according to claim 1, which includes a back assembly pivotally connected to said seat assembly, said support rods having front ends which are pivotally connected to said housing to permit downward tilting of said seat assembly and back ends which are pivotally connected to said back assembly to effect downward tilting of said seat assembly in response to rearward tilting of said back assembly, said seat assembly being slidable on said support rods to permit said sliding positional adjustment of said seat assembly.

6. A chair according to claim 5, wherein said chair includes a lock mechanism connected to said seat assembly which releasably prevents said sliding of said seat assembly along said support rods.

7. A chair according to claim 1, wherein said body portion and said seat member include cooperating flanges which are slidably engaged with each other to secure said body portion and said seat member together, said body portion further including projections which snap-lockingly engage said seat member to prevent disengagement of said cooperating flanges.

8. A chair according to claim 7, wherein said flanges slide horizontally into engagement with each other, said projections being defined by cantilevered fingers which project horizontally from said body portion and prevent relative horizontal sliding of said cooperating flanges when said fingers are in snap-locking engagement with said seat member.

9. A chair according to claim 1, wherein said slide bearings are generally U-shaped so as to fit downwardly onto said support rods and provide vertical and sideward support to said seat member while permitting sliding of said seat member along said support rods.

10. A chair according to claim 9, wherein said body portion has a generally upward-opening U-shape which fits upwardly onto said support rods.

11. In an office-type chair having a base which includes a pedestal and a housing mounted to an upper section of said pedestal, and a seat-back arrangement supported on said housing, said seat-back arrangement including a seat assembly which is disposed above said housing and a seat support assembly interconnecting said seat assembly to said housing, said seat support assembly defining a slidable connection which permits sliding positional adjustment of said seat assembly relative to said housing in a front-to-back direction of said chair, comprising the improvement wherein said seat support assembly includes a plurality of generally parallel and horizontally elongate support rods positioned under said seat assembly and projecting generally parallel to said front-to-back direction, said seat assembly including a seat member having a plurality of generally U-shaped bearings disposed on an underside of said seat member in supportive and sliding engagement with said support rods, each of said bearings including a central bearing section which supports said seat member vertically on said support rod and side bearing sections disposed on opposite sides of said support rod to provide sideward support to said seat member, said seat support assembly further including a plurality of retainers which are releasably engaged with the underside of said seat member, each said retainer having a body portion which extends generally around an underside of a respective one of said support rods such that said seat member and said retainer extend about the periphery of said respective support rod to define an opening in which said support rod is confined, said support rod being slidable through said opening to permit sliding of said seat member relative thereto.

12. A chair according to claim 11, wherein said retainers have an upward-opening U-shape which fits upwardly on said support rod.

13. A chair according to claim 12, wherein said U-shape of said retainer is defined by vertically extending side sections between which said support rod is slidably received.

14. A chair according to claim 11, wherein said seat member defines a downwardly opening pocket in which said bearing is seated, said retainer including upwardly extending legs which connect to said seat member on opposite sides of said bearing.

15. A chair according to claim 14, wherein each said support rod is cylindrical and supported at its opposite ends on said base, each said bearing defining a downward-opening concave bearing surface.

16. A chair according to claim 15, wherein said retainer and said seat member include cooperating flanges which slidably engage together by sliding of said retainer horizontally relative to said seat member.

17. In an office-type chair having a base which includes a pedestal and a housing mounted on said pedestal, and a seat-back arrangement supported on and interconnected to said housing, said seat-back arrangement including a seat assembly which is disposed above said housing and includes a seat support assembly interconnecting said seat assembly to said housing wherein said seat support assembly defines a slidable connection which permits sliding positional adjustment of said seat assembly relative to said housing in a front-to-back direction of said chair, comprising the improvement wherein said seat support assembly includes horizontally elongate support rods having opposite ends supported on said base and an intermediate section of said support rod which is suspended between said opposite ends, said seat assembly including a seat member having a plurality of retainers removably connected to an underside of said seat member, each said retainer having a body portion which extends generally around an underside of a respective one of said support rods such that said seat member and said retainer define an opening therebetween through which said support rod is slidably received, said retainer and said seat member extending around the periphery of said support rod such that said support rod is captivated therebetween and said seat member is slidable horizontally along said intermediate section thereof.

18. A chair according to claim 17, wherein said seat member is vertically supported on said support rods and said retainers extend around said support rods so as to prevent said seat member from being removed from said support rods.

19. A chair according to claim 18, wherein a bearing part is disposed vertically between said support rod and said seat member so as to facilitate sliding of said seat member along said support rods.

20. A chair according to claim 18, wherein said retainer includes side sections which extend vertically, the upper ends of which being connected to said seat member so as to captivate said support rod therebetween.

* * * * *

UNITED STATES PATENT AND TRADEMARK OFFICE
CERTIFICATE OF CORRECTION

PATENT NO : 6 027 169
DATED : February 22, 2000
INVENTOR(S) : Richard N. ROSLUND, Jr.

It is certified that error appears in the above-identified patent and that said Letters Patent are hereby corrected as shown below:

On the title page, item [75]; change "Georgetown Township" to ---Jenison---.

In the Abstract, line 5; change "bases" to ---base,---.

Column 18, line 5; change "Claim 18" to ---Claim 17---.

Signed and Sealed this

Tenth Day of April, 2001

*Attest:*

Nicholas P. Godici

NICHOLAS P. GODICI

*Attesting Officer*

*Acting Director of the United States Patent and Trademark Office*